US006462490B1

(12) United States Patent
Matsuda et al.

(10) Patent No.: US 6,462,490 B1
(45) Date of Patent: Oct. 8, 2002

(54) METHOD AND APPARATUS FOR CONTROLLING CIRCULAR ACCELERATOR

(75) Inventors: Koji Matsuda, Hitachi; Takahide Nakayama, Nara, both of (JP)

(73) Assignees: Hitachi, Ltd., Tokyo (JP); Hitachi Information & Control Systems, Inc., Ibaraki (JP)

( * ) Notice: Subject to any disclaimer, the term of this patent is extended or adjusted under 35 U.S.C. 154(b) by 0 days.

(21) Appl. No.: 09/525,013

(22) Filed: Mar. 14, 2000

(30) Foreign Application Priority Data

Jul. 29, 1999 (JP) ..... 11-214617

(51) Int. Cl.[7] ..... H05H 7/02

(52) U.S. Cl. ..... 315/507; 315/503; 315/111.61; 250/505.1; 250/492.3

(58) Field of Search ..... 315/507, 503, 315/111.61; 250/505.1, 492.3

(56) References Cited

U.S. PATENT DOCUMENTS 5,107,222 A * 4/1992 Tsuzuki ..... 328/233
5,538,494 A * 7/1996 Matsuda ..... 600/1

* cited by examiner

*Primary Examiner*—Bruce Anderson
*Assistant Examiner*—Nikita Wells
(74) *Attorney, Agent, or Firm*—Mattingly, Stanger & Malur, P.C.

(57) ABSTRACT

A control method and apparatus of a circular accelerator can adjust a timing of emitting a charged particle beam in the circular accelerator. Generation of a clock pulse having a fixed period is suspended after acceleration of the charged particle beam has been ended and the generation of the clock pulse is resumed when a beam irradiation request is produced on the basis of a state of an object to be irradiated during the suspension state of generation of the clock pulse. An emitter is operated in accordance with the clock pulse generated again.

7 Claims, 5 Drawing Sheets

FIG. 4

| CLOCK PULSE NO. | CURRENT COMMAND VALUE TO POWER SUPPLY 12 | CURRENT COMMAND VALUE TO POWER SUPPLY 13 |
|---|---|---|
| 1 | 0 | 0 |
| 2 | Ia | 0 |
| ⋮ | Ia | 0 |
| 5 | Ib | 0 |
| 6 | Ic | 0 |
| 7 | Id | 0 |
| 8 | Ie | 0 |
| 9 | Ie | If |
| ⋮ | Ie | If |
| 13 | Id | 0 |
| 14 | Ic | 0 |
| 15 | Ib | 0 |
| 16 | Ia | 0 |
| ⋮ | Ia | 0 |
| 19 | 0 | 0 |

※ $Ia < Ib < Ic < Id < Ie$

FIG. 5

| CLOCK PULSE NO. | CLOCK PULSE GENERATOR | PRE-STAGE ACCELERATOR CONTROL UNIT | INJECTOR CONTROL UNIT | HIGH-FREQUENCY ACCELERATING CAVITY CONTROL UNIT | EMITTER CONTROL UNIT |
|---|---|---|---|---|---|
| 1 | OFF | OFF | OFF | OFF | OFF |
| 2 | ON | ON | ON | OFF | OFF |
| 3 | ON | ON | ON | OFF | OFF |
| 4 | ON | OFF | OFF | OFF | OFF |
| 5 | ON | OFF | OFF | ON | OFF |
| ⋮ | ON | OFF | OFF | ON | OFF |
| 8 | OFF | OFF | OFF | ON | OFF |
| 9 | ON | OFF | OFF | ON | ON |
| ⋮ | ON | OFF | OFF | ON | ON |
| 13 | ON | OFF | OFF | OFF | OFF |
| ⋮ | ON | OFF | OFF | OFF | OFF |
| 19 | ON | OFF | OFF | OFF | OFF |

METHOD AND APPARATUS FOR CONTROLLING CIRCULAR ACCELERATOR

BACKGROUND OF THE INVENTION

The present invention relates to a method and apparatus for controlling a circular accelerator for accelerating a charged particle beam injected thereto to emit the accelerated beam and more particularly to a control method and apparatus of a circular accelerator for performing injection, acceleration and emission of a charged particle beam on the basis of a clock pulse.

As a control method of a circular accelerator for accelerating a charged particle beam injected thereto to emit the accelerated beam, there is a method of controlling injection, acceleration, emission and deceleration of a charged particle beam in a circular accelerator on the basis of a clock pulse generated from a pulse generator at a fixed period.

More particularly, when injection, acceleration, emission and deceleration of the charged particle beam is performed in the circular accelerator, a pattern of command values (for example, current values) to be supplied to devices such as an electromagnet and a high-frequency accelerating cavity constituting the circular accelerator is previously stored in corresponding manner to the number of clock pulses and the previously stored command values are supplied to the devices on the basis of the number of clock pulses generated from the pulse generator. The stored command values are repeatedly supplied to the devices of the circular accelerator, so that the circular accelerator performs injection, acceleration, emission and deceleration at a fixed period repeatedly.

The charged particle beam emitted from the circular accelerator is used in various fields such as medical treatment for a cancer patient and sterilization of food, while it is desired that the charged particle beam is emitted in accordance with a state of an object to be irradiated in any cases. Particularly, when the charged particle beam is used for treatment of cancer, a position of the diseased part is changed in accordance with breath, heartbeat or the like of a patient and accordingly the diseased part cannot be irradiated with the charged particle beam if the circular accelerator is not controlled to emit the charged particle beam when the diseased part is located in a set position. That is, it is desired that the timing of emission of the charged particle beam in the circular accelerator can be adjusted in accordance with a changed position of the diseased part.

In the prior art, however, previously set command values are supplied to the devices in accordance with the clock pulse generated at a fixed period and accordingly injection, acceleration, emission and deceleration of the charged particle beam are performed at a fixed period, so that the timing of emission in the circular acceleration cannot be adjusted.

SUMMARY OF THE INVENTION

It is an object of the present invention to provide a control method and apparatus of a circular accelerator capable of adjusting the timing of emission of a charged particle beam.

In order to achieve the above object, according to the present invention, in a control method of a circular accelerator for controlling timing of injection, acceleration and emission of a charged particle beam in the circular accelerator on the basis of a clock pulse generated at a set period, generation of the clock pulse is suspended after acceleration of the charged particle beam has been ended and generation of the clock pulse is resumed when a beam irradiation request is produced on the basis of a state of an object to be irradiated during the suspension state of generation of the clock pulse.

Since the generation of the clock pulse is suspended after the acceleration of the charged particle beam has been ended and the generation of the clock pulse is resumed when the beam irradiation request is produced during the suspension state of generation of the clock pulse, the resumption timing of generation of the clock pulse can be adjusted in accordance with the timing that the beam irradiation request is produced and accordingly the timing of emission of the charged particle beam can be controlled on the basis of the clock pulse.

BRIEF DESCRIPTION OF THE DRAWINGS

FIG. 4 shows an example of information stored in a control pattern storage unit 104 of FIG. 3; and FIG. 5 shows an example of information stored in a control pattern storage unit 105 of FIG. 3.

DESCRIPTION OF THE EMBODIMENT

An embodiment of the present invention is now described in detail with reference to the accompanying drawings.

Figure 2:
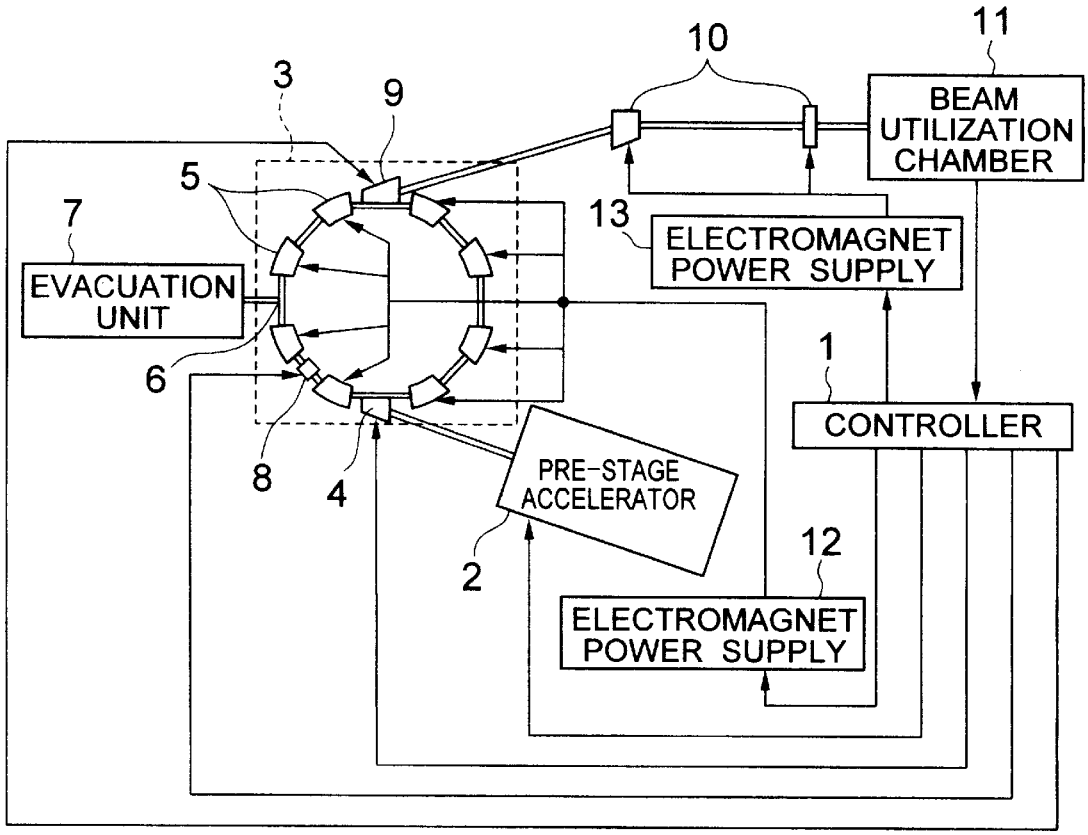
FIG. 2 is a schematic diagram illustrating a circular accelerator system according to a preferred embodiment of the present invention.

FIG. 2 schematically illustrates a circular accelerator system according to a preferred embodiment of the present invention. The circular accelerator system of the embodiment employs a synchrotron as a circular accelerator for accelerating an ion beam (hereinafter referred to as beam) and is used to irradiate the diseased part (object to be irradiated) of a cancer patient with the beam accelerated in the synchrotron to treat cancer.

Operation of the circular accelerator system made until the diseased part of the patient is irradiated with the beam is now described. In FIG. 2, a controller 1 supplies a beam emission command to a pre-stage accelerator 2 in response to a beam injection request signal produced from a beam utilization chamber 11. The pre-stage accelerator 2 generates ions in response to the beam emission command inputted-thereto and emits a beam. At the same time that the beam emission command is supplied to the pre-stage accelerator 2 , the controller 1 gives a beam injection command to an injector 4 of a synchrotron 3 and further supplies to a power supply of a deflection electromagnet 5 (electromagnet power supply 12) a current value required to deflect the beam emitted from the pre-stage accelerator 2 by the deflection electromagnet 5 as a current command value.

The beam emitted by the pre-stage accelerator 2 is injected to the synchrotron 3 by means of the injector 4 to which the beam injection command is supplied. The electromagnet power supply 12 supplies the current of the value designated thereto by the controller 1 to the deflection electromagnet 5 of the synchrotron 3 and the beam injected to the synchrotron 3 is defected by a magnetic field generated by the deflection electromagnet 5 and moves around within a vacuum container 6. The inside of the vacuum container 6 is kept to vacuum by means of an evacuation unit 7.

Then, the controller 1 supplies a command value of a voltage applied to the beam to a high-frequency accelerating cavity 8. The high-frequency accelerating cavity 8 supplies the voltage to the moving beam on the basis of the command value supplied from the controller 1, so that the beam applied with the voltage is punched and comes into an accelerable state. This state is named capture. Then, the controller 1 controls an amplitude, a frequency and a phase of a voltage applied to the beam from the high-frequency accelerating cavity 8 to increase energy of the beam. This operation is named acceleration. Further, when the beam is accelerated, the strength of the magnetic field of the deflection electromagnet 5 is increased gradually with increase of the energy of the beam so that a track of the beam is prevented from coming off from the vacuum container 6. The increase of the strength of the magnetic field of the deflection electromagnet 5 is made by increasing the current command value applied to the electromagnet power supply 12 from the controller 1.

When the beam energy reaches a target energy required to irradiate the diseased part of the patient, an amplitude, a frequency and a phase of the voltage applied to the beam from the high-frequency accelerating cavity 8 are controlled by the controller 1 so that the beam energy is maintained to the target energy. That is, acceleration of the beam is ended. When the acceleration is ended and a beam emission request signal is produced from the beam utilization chamber 11, the controller 1 supplies the beam emission command to an emitter 9 and the emitter 9 supplied with the beam emission command emits a beam from the synchrotron 3. At the same time that the beam emission command is supplied to the emitter 9, the controller 1 supplies to a power supply 13 (electromagnet power supply 13) for a transportation-system electromagnet 10 a command value of a current required in the transportation-system electromagnet 10 to transport the beam emitted from the synchrotron 3. The electromagnet power supply 13 supplied with the current command value supplies the current corresponding to the current command value to the transportation-system electromagnet 10, so that the transportation-system electromagnet 10 generates a magnetic field in response to the current applied thereto. The beam emitted from the synchrotron 3 is transported to the beam utilization chamber 11 by the magnetic field generated by the transportation system electromagnet 10 and is irradiated to the diseased part of the patient in the beam utilization chamber 11.

As described above, the controller 1 controls the pre-stage accelerator 2, the synchrotron 3 and the like so that the diseased part of the patient is irradiated with the beam.

Control of the units by the controller 1 is now described in detail.

Figure 3:
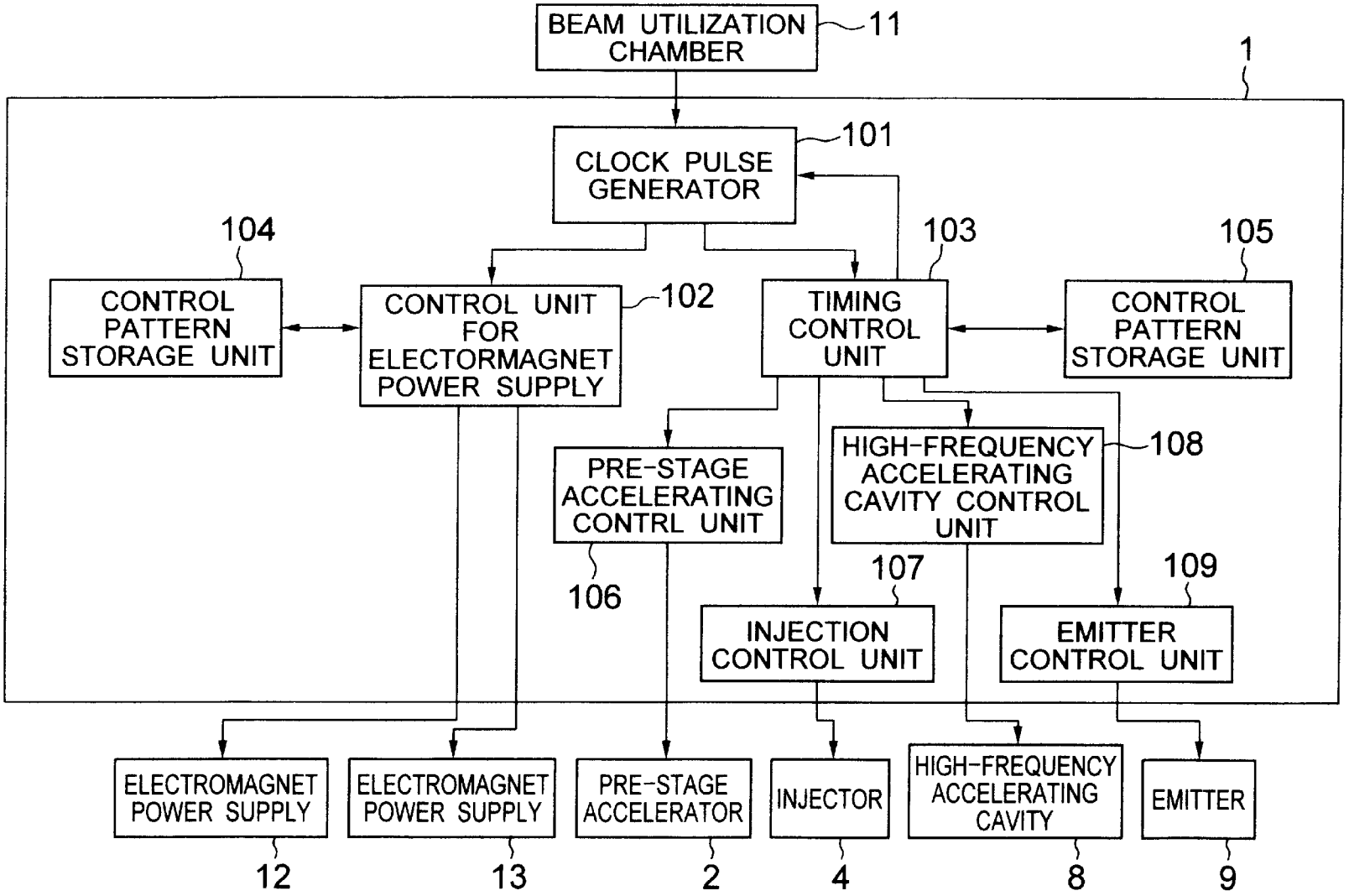
FIG. 3 is a block diagram illustrating a controller 1 of FIG. 2.

FIG. 3 schematically illustrates the controller 1 of the embodiment. In FIG. 3, a clock pulse generator 101 generates a clock pulse at a previously set period (fixed period). The clock pulse generated by the clock pulse generator 101 is supplied to a control unit 102 for power supply of electromagnet and a timing control unit 103.

When the electromagnet-power-supply control unit 102 is supplied with the clock pulse from the clock pulse generator 101, the control unit 102 supplies current command values to the electromagnet power supplies 12 and 13 on the basis of information stored in a control pattern storage unit 104. An example of the information stored in the control pattern storage unit 104 is shown in FIG. 4. As shown in FIG. 4, current command values to the electromagnet power supplies 12 and 13 are stored in corresponding manner to a-number (No.) of the clock pulse in the control pattern storage unit 104. The clock pulse is given a number (No.) when it is generated by the clock pulse generator 101.

On the other hand, when the timing control unit 103 is applied with the clock pulse from the clock pulse generator 101, the timing control unit 103 supplies on-and-off signals to a pre-stage accelerator control unit 106, an injector control unit 107, a high-frequency accelerating cavity control unit 108 and an emitter control unit 109 on the basis of the information stored in the control pattern storage unit 105. An example of the information stored in the control pattern storage unit 105 is shown in FIG. 5. As shown in FIG. 5, information relative to the on-and-off signals supplied to the control units is stored in corresponding manner to a number (No.) of the clock pulse in the control pattern storage unit 105. The pre-stage accelerator control unit 106, the injector control unit 107, the high-frequency accelerating cavity control unit 108 and the emitter control unit 109 supplied with the on-and-off signals from the timing control unit 103 control the pre-stage accelerator 2, the injector 4, the high-frequency accelerator cavity 8 and the emitter 9, respectively.

Figure 1:
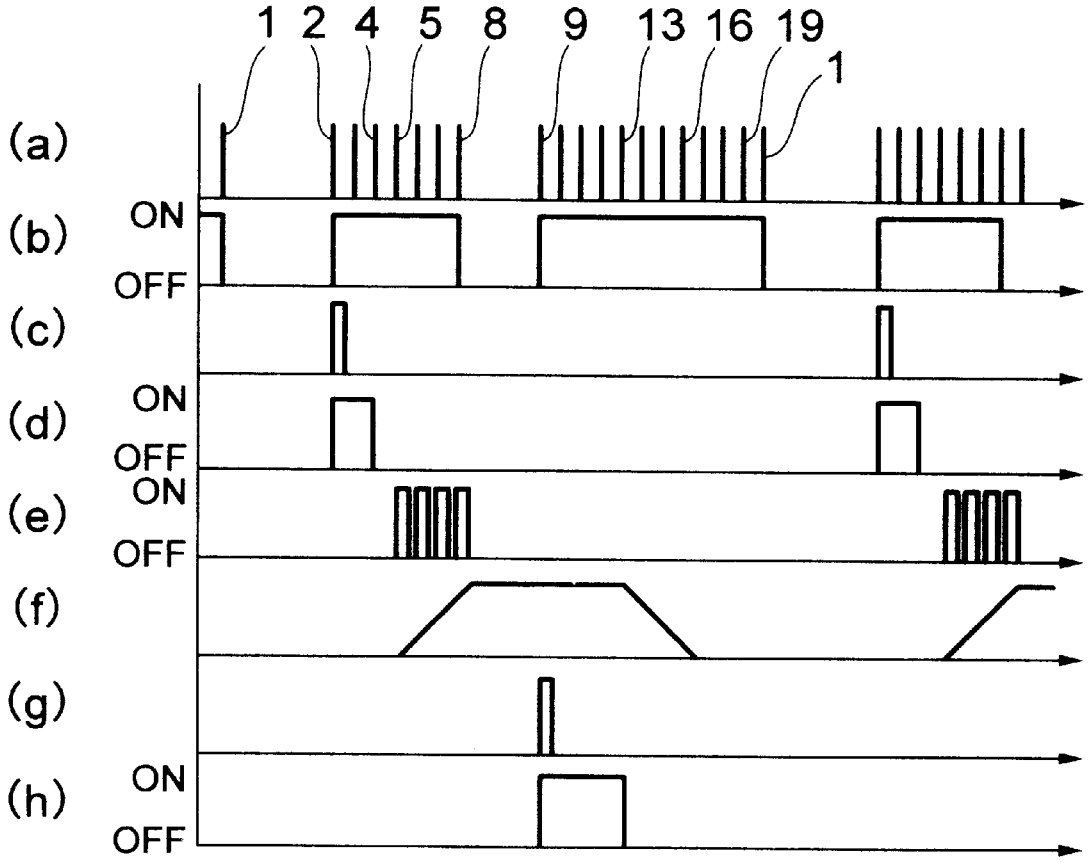
FIG. 1 shows waveforms of signals generated in a controller 1 of FIG. 2.

FIG. 1 shows signals generated in the controller 1 of the embodiment. When the clock pulse shown in FIG. 1(*a*) is generated from the clock pulse generator 101 and the clock pulse No. 1 is inputted to the timing control unit 103, the timing control unit 103 produces an off signal as shown in FIG. 1(*b*) on the basis of the information stored in the control pattern storage unit 105 to supply the off signal to the clock pulse generator 101. The clock pulse generator 101 suspends generation of the clock pulse in response to the off signal inputted thereto as shown in FIG. 1(*a*).

During the suspension state of generation of the clock pulse, when the beam injection request signal shown in FIG. 1(*c*) is inputted to the clock pulse generator 101 from the beam utilization chamber 11, the clock pulse generator 101 resumes generation of the clock pulse as shown in FIG. 1(*a*). In the embodiment, when the position of the diseased part is located at a first previously set position, the beam injection request signal is produced from the beam utilization chamber 11. A position detection apparatus (not shown) for detecting a position of the diseased part is disposed in the beam utilization chamber 11 and the beam injection request signal is produced in response to the detection result of the position detection apparatus.

When the clock pulse generator 101 resumes generation of the clock pulse and a first clock pulse from the resumption, that is, the clock pulse No. 2 is inputted to the timing control unit 103, the timing control unit 103 supplies an on signal to the pre-stage accelerator control unit 106 and the injector control unit 107 as shown in FIG. 1(*d*). The pre-stage accelerator control unit 106 supplies a beam emission command to the pre-stage accelerator 2 in response to the inputted on signal. On the other hand, the injector control unit 107 supplies a beam injection command to the injector 4 in response to the inputted on signal. Further, when the electromagnet-power-supply control unit 102 is supplied with the clock pulse No. 2, the control unit 102 supplies a current command value to the electromagnet power supply 12. The electromagnet power supply 12 supplies a current corresponding to the inputted current command value to the deflection electromagnet 5. As described in connection with FIG. 2, when the controller 1 applies the beam emission command to the pre-stage accelerator 2, the pre-stage accelerator 2 emits the beam and the emitted beam is injected to the synchrotron 3 by means of the injector 4 inputted with the beam injection command. Furthermore, the beam injected to the synchrotron 3 is deflected by the deflection electromagnet 5 to which the current is supplied from the electromagnet power supply 12, so that the beam moves around within the vacuum container 6.

The clock pulse generator 101 generates the clock pulse at the fixed period and when the clock pulse No. 4 is inputted to the timing control unit 103, off signals are outputted as shown in FIG. 1(*d*) to be supplied to the pre-stage accelerator control unit 106 and the injector control unit 107. That is, injection of the beam to the synchrotron 3 is ended. In the embodiment, the injection of the beam is ended at the time that a third clock pulse as counted from the start of injection of the beam in the synchrotron 3 is generated, although the number of the clock pulses is not limited to three and the time sufficient to end the injection of beam may be provided. The number of clock pulses required to inject the beam is varied in accordance with the time interval of generating the clock pulse or the time required to inject the beam.

When the timing control unit 103 is supplied with the clock pulse No. 5, the timing control unit 103 produces an on signal as shown in FIG. 1(*e*) on the basis of the information stored in the control pattern storage unit 105 to supply the on signal to the high-frequency accelerating cavity control unit 108. The high-frequency accelerating cavity control unit 108 supplies the command value of the voltage applied to the beam to the high-frequency accelerating cavity 8. Further, each time the clock pulse generator 101 generates the clock pulses Nos. 6 to 8, the timing control unit 103 produces the on signals as shown in FIG. 1(*e*) to supply the on signals to the high-frequency accelerating cavity control unit 108. Each time the on signal is inputted, the high-frequency accelerating cavity control unit 108 changes the command value of the voltage applied to the high-frequency accelerating cavity 8 to thereby vary the amplitude, the frequency and the phase of the voltage applied to the beam from the high-frequency accelerating cavity 8 so that the beam is accelerated. Further, in the embodiment, the time required to generate the four clock pulses Nos. 5 to 8 are used for acceleration of the beam, while the number of clock pulses is set to satisfy the time required to obtain a previously calculated acceleration.

The electromagnet-power-supply control unit 102 increases the current command value applied to the electromagnet power supply 12 as shown in FIG. 1(*f*) when the clock pulse No. 5 is inputted. The electromagnet power supply 12 increases the current supplied to the deflection electromagnet 5 in accordance with the increased current command value. Further, since the electromagnet-powersupply control unit 102 increases the current command value applied to the electromagnet power supply 12 gradually as shown in FIG. 1(*f*) each time the clock pulses Nos. 6 to 8 are produced from the clock pulse generator 101, the current produced from the electromagnet power supply 12 is also increased. Accordingly, the magnetic field generated by the deflection electromagnet 5 is increased in accordance with the acceleration of the beam, so that the beam is moved around within the vacuum container 6 of the synchrotron 3 stably.

When the clock pulse No. 8 is inputted to the timing control unit 103, the timing control unit 103 supplies the off signal as shown in FIG. 1(*b*) to the clock pulse generator 101.

The clock pulse generator 101 suspends generation of the clock pulse in response to the inputted off signal.

During the suspension state of the clock pulse, when the beam utilization chamber 11 produces a beam emission request signal (that is, beam irradiation request signal) as shown in FIG. 1(*g*), the clock pulse generator 101 resumes the generation of the clock pulse. In the embodiment, when the position of the diseased part is set to a second previously set position, the beam emission request signal is produced from the beam utilization chamber 11. When the generation of the clock pulse is resumed and a first clock pulse (No. 9) is inputted to the timing control unit 103, the timing control unit 103 supplies the on signal as shown in FIG. 1(*h*) to the emitter control unit 109. The emitter control unit 109 supplies the beam emission command to the emitter 9 in response to the inputted on signal. The emitter 9 emits the moving beam from the synchrotron 3 in response to the inputted beam emission command.

On the other hand, the electromagnet-power-supply control unit 102 supplies the current command value to the electromagnet power supply 13 when the generation of the clock pulse is resumed and the first clock pulse (No. 9) is inputted to the control unit 102. The electromagnet power supply 13 supplies the current corresponding to the inputted current command value to the transportation system electromagnet 10. The transportation system electromagnet 10 supplied with the current transports the beam emitted from the synchrotron 3 to the beam utilization chamber 11.

When the clock pulse No. 13 is produced from the clock pulse generator 101, the timing control unit 103 supplies the off signal to the emitter control unit 109. The emitter control unit 109 stops the supply of the beam emission command to the emitter 9 in response to the inputted off signal. That is, emission of the beam in the synchrotron 3 is stopped. Further, in the embodiment, the beam is emitted while the five clock pulses Nos. 9 to 13 are generated, although the number of clock pulses is not limited to five and the time sufficient to emit the beam may be provided.

When the clock pulse No. 13 is inputted, the electromagnet-power-supply control unit 102 stops the supply of the current command value to the electromagnet current 13 and begins to reduce the current command value supplied to the electromagnet power supply 12 as shown in FIG. 1(*f*). The reduction of the current command value supplied to the electromagnet 12 is made until the clock pulse No. 16 is inputted.

Thus, when the clock pulse No. 19 is generated after the injection, acceleration, emission and deceleration of the beam in the synchrotron 3 have been performed, the clock pulse generated by the clock pulse generator is returned to the clock pulse No. 1 again and the injection, acceleration, emission and deceleration of the beam in the synchrotron 3 is repeated.

As described above, in the embodiment, when the clock pulse No. 1 is generated, the generation of the clock pulse in the clock pulse generator 101 is suspended and when the beam injection request signal is produced from the beam utilization chamber 11 during the suspension state of generation of the clock pulse, the beam is injected. That is, when the synchrotron 3 is maintained in the waiting state and the request is issued from the beam utilization chamber 11, the beam is injected. Further, in the embodiment, when the clock pulse No. 8 is generated, the generation of the clock pulse in the clock pulse generator 101 is suspended and when the beam emission request signal Ad is issued from the beam utilization chamber 11 during the suspension state of generation of the clock pulse, the beam is emitted. That is, when the synchrotron 3 is maintained in the waiting state and the request is issued from the beam utilization chamber 11, the beam is emitted.

In this manner, since the beam is emitted from the synchrotron 3 at any timing in response to the request from the beam utilization chamber 11, the beam can be emitted when the diseased part is set in the previously set position.

Accordingly, the diseased part can be irradiated with the beam exactly. For example, since the position of the diseased part is stabilized when the patient has breathed out completely, the position of the diseased part at this time is set to the second set position in the embodiment and the beam can be emitted from the synchrotron 3 when the diseased part is located in the second set position to thereby irradiate the diseased part with the beam exactly. Further, since the injection of the beam to the synchrotron 3 is made at any time in accordance with the request from the beam utilization chamber 11, the timing that the synchrotron 3 becomes to the state that the beam can be emitted can be adjusted. That is, since the time required to accelerate the beam can be understood previously, the first set position (injection timing) can be set in consideration of the time required for the acceleration to thereby exactly control the synchrotron 3 so that the synchrotron 3 becomes to the state that the beam can be emitted when the diseased part is in the second set position. For example, the position of the diseased part at the time that the patient breathes in can be set in the first set position in the embodiment to thereby control the synchrotron 3 so that the synchrotron 3 becomes to the state that the beam can be emitted when the patient breathes out, that is, when the diseased part is in the second set position.

Furthermore, in the embodiment, the emission of the beam in the synchrotron 3 is made while the clock pulses Nos. 9 to 13 are generated, although the emission of the beam can be suspended in response to a request of the beam utilization chamber 11. For example, when irradiation of the beam in a necessary dose is completed or when the diseased part is shifted from the set position or the like, the emission of the beam is suspended in response to the request of the beam utilization chamber 11 even if the beam is left in the synchrotron 3. More particularly, when the beam emission suspension request is produced from the beam utilization chamber 11, the clock pulse generator 101 may generate the clock pulse No. 13. Consequently, the diseased art can be irradiated with the beam more exactly. Further, ineffective irradiation of the beam can be removed to thereby suppress exposure of apparatuses to radiation and further reduce electric power.

Further, in the embodiment, the timing for operating the units is controlled on the basis of the number (No.) of the clock pulse, although there may be provided a counter for counting the clock pulse and the operation timing of the units may be controlled in accordance with the count of the counter. When the synchrotron 3 comes into the waiting state in the case where the counter is used, the same control can be made even if counting of the counter is suspended instead of suspension of generation of the clock pulse from the clock pulse generator. Moreover, instead of control of the operation timing of the units based on the number (No.) of the clock pulse, the operation timing of the units may be set on the basis of a delay time from a signal synchronized with the operation period of the synchrotron 3 as the beam injection request signal.

Further, in the embodiment, it is desirable that a method of producing resonance in a beam having an increased amplitude of oscillation and emitting the beam after increasing an amplitude of oscillation of a beam in a betatron by applying a high-frequency electromagnetic field to the moving beam is applied to the emission of the beam from the synchrotron 3. In this emission method, since turning on and off of emission of a beam can be made exactly in a short time, the diseased part can be irradiated exactly.

Further, in the embodiment, the beam is used for treatment of cancer, while the present invention is not limited to treatment of cancer and can be applied to any application requiring to control a beam emission timing in response to an irradiation request according to a state of an object to be irradiated.

As described above, according to the present invention, the timing of emitting the charged particle beam can be controlled.

What is claimed is:

1. A control method of a circular accelerator for controlling timing of injection, acceleration and emission of a charged particle beam in the circular accelerator on the basis of a clock pulse generated at a set period, comprising:

suspending generation of the clock pulse, when said charged particle beam has reached a target energy by said acceleration thereof; and thereafter resuming generation of the clock pulse in response to a beam irradiation request produced during a state of said suspension of generation of said clock pulse.

2. A control method of a circular accelerator according to claim 1, wherein said object to be irradiated is a diseased part of a cancer patient and said beam irradiation request is produced when said diseased part is located in a previously set position.

3. A control method of a circular accelerator according to claim 1, further comprising the step of emitting said charged particle beam having reached said target energy from said circular accelerator after said resumption of generation of the clock pulse in response to said beam irradiation request.

4. A control method of a circular accelerator for controlling timing of injection, acceleration and emission of a charged particle beam in the circular accelerator on the basis of a clock pulse generated at a set period, comprising:

suspending generation of the clock pulse, when said charged particle beam has reached a target energy by said acceleration thereof;

thereafter resuming generation of the clock pulse in response to a first beam irradiation request produced during a first state of said suspension of generation of said clock pulse;

suspending generation of the clock pulse before injection of said charged particle beam into said circular accelerator and after deceleration of said charged particle beam in said circular accelerator; and thereafter resuming generation of the clock pulse in response to a second beam irradiation request produced during a second state of said suspension of generation of the clock pulse before said injection of said charged particle beam into said circular accelerator and after said deceleration of said charged particle beam in said circular accelerator.

5. A control method of a circular accelerator according to claim 4, wherein said object to be irradiated is a diseased part of a cancer patient and said beam irradiation request is produced when said diseased part is located in a previously set position.

6. A control method of a circular accelerator according to claim 4, further comprising the step of emitting said charged particle beam having reached said target energy from said circular accelerator after said resumption of generation of the clock pulse in response to said first beam irradiation request.

7. A control apparatus of a circular accelerator including clock pulse generation means for generating a clock pulse at a set period and timing control means for controlling timing of injection, acceleration and emission of a charged particle beam in the circular accelerator on the basis of the clock pulse generated by said clock pulse generation means, wherein said timing control means suspends generation of the clock pulse from said clock pulse generation means, when said charged particle beam has reached a target energy by said acceleration thereof, and said clock pulse generation means resumes generation of the clock pulse, when a beam irradiation request is inputted during a state of said suspension of generation of said clock pulse.

* * * * *